US006254314B1

(12) United States Patent
Park et al.

(10) Patent No.: US 6,254,314 B1
(45) Date of Patent: Jul. 3, 2001

(54) COVERING PLATE ASSEMBLY FOR STEEL PIPE PILES

(75) Inventors: Young Ho Park; Sung Hwan Kim, both of Sungnam-Shi; Kyung Suk Kim, Seoul; Sung Min Cho, Songpa-Ku; Ki Hong Lee, 101-2303 Sangwoo Apt., 473 Gaebong-Dong, Guro-Gu, Seoul 152-090, all of (KR)

(73) Assignees: Korea Highway Corporation, Kyongki-Do; Ki Hong Lee, Seoul, both of (KR)

( * ) Notice: Subject to any disclaimer, the term of this patent is extended or adjusted under 35 U.S.C. 154(b) by 0 days.

(21) Appl. No.: 09/323,903

(22) Filed: Jun. 2, 1999

(30) Foreign Application Priority Data

Dec. 17, 1998 (KR) ..... 98-55835
Feb. 18, 1999 (KR) ..... 99-5395

(51) Int. Cl.[7] ..... E02D 5/46; E02D 5/62; E04H 12/00

(52) U.S. Cl. ..... 405/255; 52/301; 405/231; 405/229; 403/383

(58) Field of Search ..... 52/301; 405/295, 405/231, 229; 403/383

(56) References Cited

U.S. PATENT DOCUMENTS

| | | | | |
|---|---|---|---|---|
| 1,048,993 | * | 12/1912 | Meriwether | 285/363 |
| 1,515,257 | * | 11/1924 | Krasnow | 52/301 |
| 1,545,456 | * | 7/1925 | Ratetter | 52/301 X |
| 2,374,624 | * | 4/1945 | Schwendt | 52/301 |
| 3,487,646 | * | 1/1970 | Gatien . | |
| 3,543,524 | * | 12/1970 | Clements | 405/255 |
| 4,472,085 | * | 9/1984 | Mohler | 405/255 |
| 4,748,778 | * | 6/1988 | Rafter, Sr. | 405/231 |
| 5,073,065 | * | 12/1991 | Kleineke | 405/259.6 |
| 5,586,417 | * | 12/1996 | Henderson et al. | 52/295 |
| 5,746,036 | * | 5/1998 | Angelette | 52/295 |
| 5,961,253 | * | 10/1999 | Okawa | 405/239 |

* cited by examiner

*Primary Examiner*—Lynne H. Browne
*Assistant Examiner*—Ernesto Garcia
(74) *Attorney, Agent, or Firm*—Bacon & Thomas, PLLC

(57) ABSTRACT

A covering plate assembly includes a bottom plate secured to an upper side of a cross reinforced plate that is in turn secured to the upper end of a pipe pile. A plurality of reinforcing rods are secured to the upper surface of the bottom plate and extend vertically from the bottom plate. The rods may be secured to the bottom plate by either welding or threaded engagement. The bottom plate may also be secured to the cross reinforced plate by either threaded engagement or welding.

7 Claims, 8 Drawing Sheets

COVERING PLATE ASSEMBLY FOR STEEL PIPE PILES

BACKGROUND OF THE INVENTION

1. Field of the Invention

This invention relates to covering plates for reinforcing steel pipe piles used in forming concrete foundations. The piles are driven to compact the ground in the construction of buildings, bridges, and the like.

2. Description of the Prior Art

Generally, the compaction of the ground is required to increase the strength of soft ground when constructing bridges and buildings. Compaction may be accomplished by general driving (rubbles, sand, long cornerstones, prestress, etc), pile driving (wood piles, ready-mix concrete, prestress concrete piles, etc), and deep foundation driving (well foundation, submerged foundation, etc).

Covering plate assemblies for the upper ends of steel pipe piles are used to support loads of upper base structures when driving steel pipe piles.

The structure of a known covering plate assembly is shown in FIG. 1. This known covering plate assembly 10 comprises a bottom plate 11 with a cross reinforced plate 12 welded to the lower side of plate 11 that, in turn, covers the upper side of a steel pipe pile 100 embedded into and protruding out of the ground. A plurality of iron reinforcing rods 20 are evenly spaced and welded around the periphery of plate 11. The upper ends of reinforcing rods 20 are bent outwardly to easily bind them with other iron reinforcing rods.

However, the covering plate assembly 10 requires that a reinforced plate 12 is secured on the lower side of a bottom plate 11. Plate 12 has to be cut, bent and produced at the construction site and then be welded to plate 11. The iron reinforcing rods and bottom plate 11 are butt-welded with round sections. Since each attaching section is short, this results in poor tension loading for an installed foundation base.

SUMMARY OF THE INVENTION

The present invention solves the problems inherent in known covering plate assemblies by providing a covering plate assembly that has iron reinforcing rods stud-welded or bolt-jointed on the upper surface of a bottom plate of the covering plate assembly. The invention is easy to use and install, and has enhanced strength.

The invention includes a cross reinforced plate on the lower side of a bottom plate that covers the upper side of a steel pipe pile. A plurality of spaced iron reinforcing rods are secured around the upper surface of the bottom plate by appropriate jointing methods. Plural cross-arranged, tightening holes are provided in the bottom plate so that the cross reinforced plate may be secured to the lower side of the bottom plate by bolts or by welding. The lower side of the bottom plate may be secured to the upper side of the cross reinforced plate by bolts or welding. The cross reinforced plate may be provided with a plurality of threaded holes for receiving bolts through holes in a pipe to secure the cross reinforced plate to the upper end of the pipe. The iron reinforcing rods may be bent vertically or outwardly.

A plurality of threaded holes may be circumferentially spaced around the upper surface of the bottom plate for engagement by threaded ends of the iron reinforcing rods to secure the rods to the bottom plate. Moreover, the upper surface of a bottom plate and the iron reinforcing rods or round rods may be joined by welding.

DETAILED DESCRIPTION OF THE PREFERRED EMBODIMENTS

Figure 1:
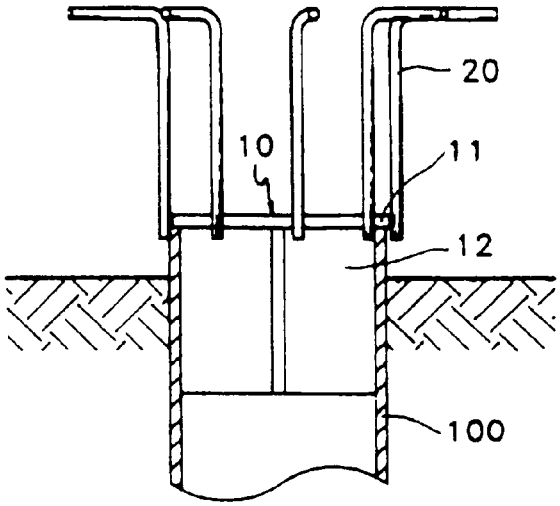
Fig. 1 PRIOR ART
FIG. 1 shows a prior art covering plate assembly installed with a pipe pile.
Figure 2:
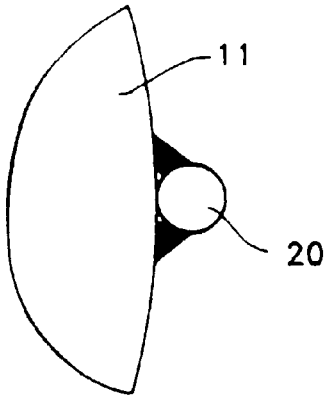
Fig. 2 PRIOR ART
FIG. 2 shows an iron reinforcing rod welded to the periphery of the bottom plate in FIG. 1.
Figure 3:
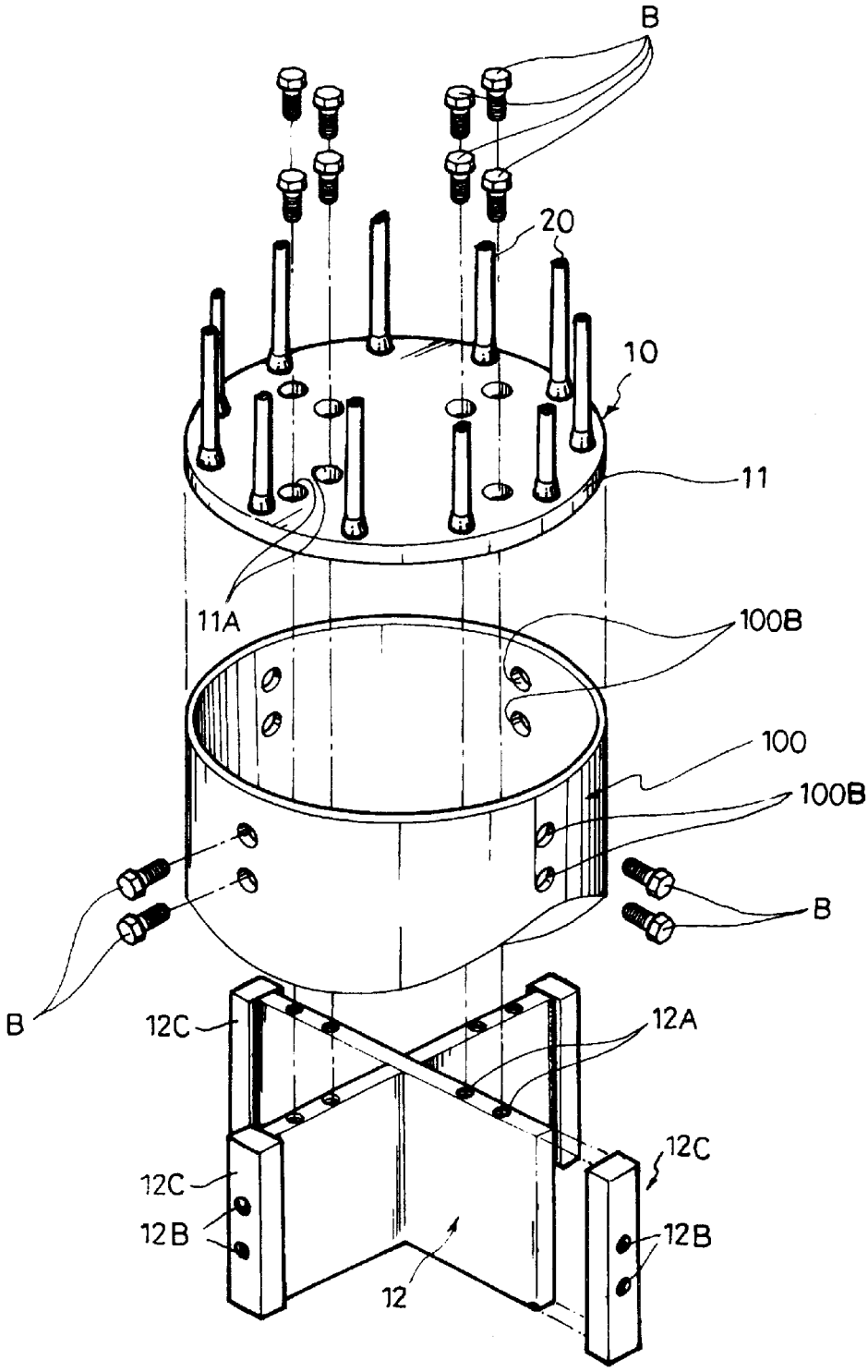
FIG. 3 is an exploded perspective view of a first embodiment of a covering plate assembly according to this invention.
Figure 4:
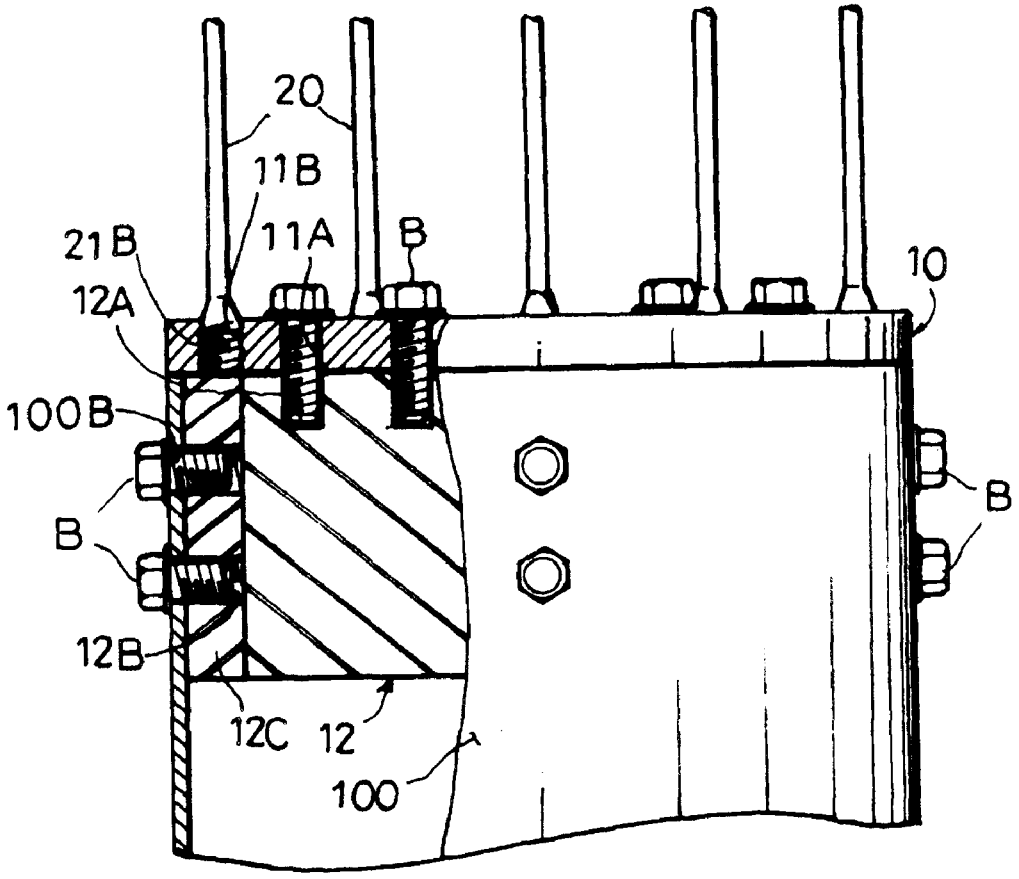
FIG. 4 shows a sectional drawing of the first embodiment.
Figure 5:
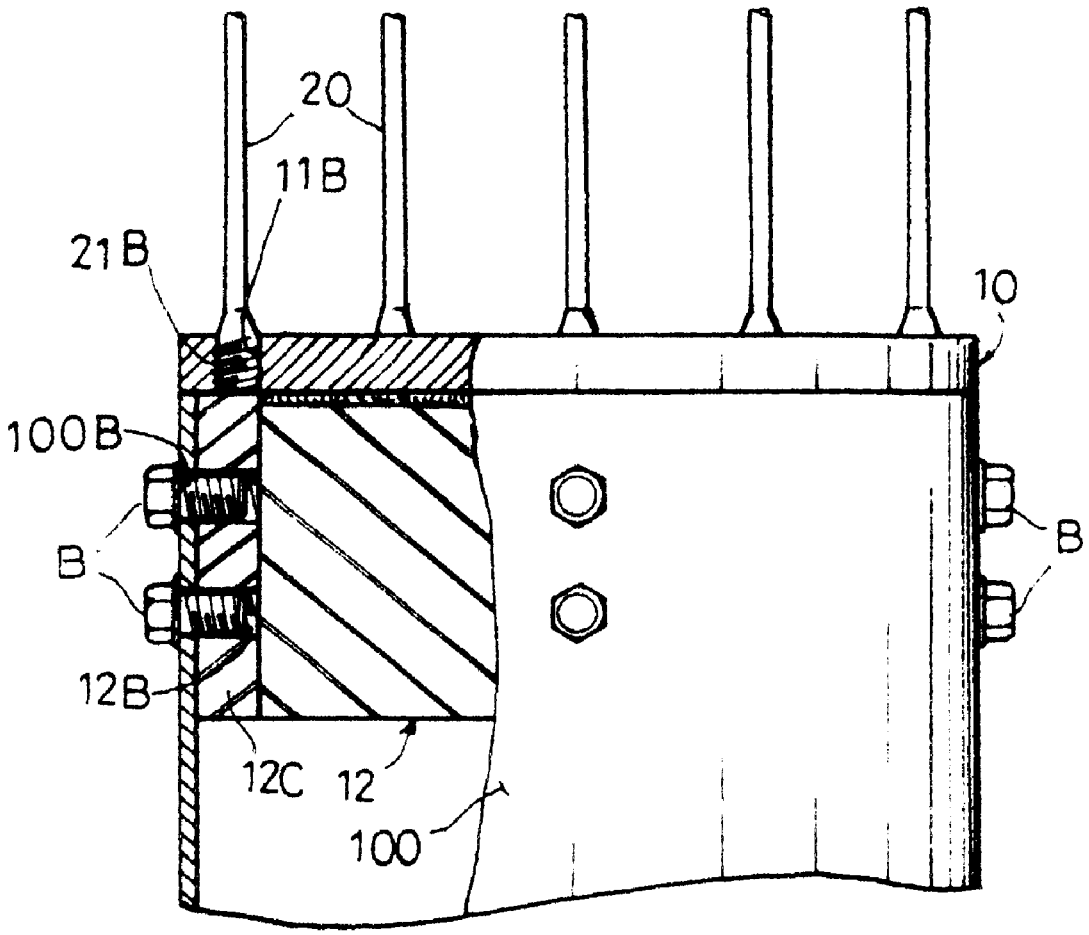
FIG. 5 shows a sectional drawing of a second embodiment of the invention wherein the bottom plate and cross reinforced plate are welded together.

A covering plate assembly 10, according to the invention, includes a cross reinforced plate 12 on the lower side of a bottom plate 11 covered on the upper end of a steel pipe pile that is installed to compact the ground, as seen in FIG. 3 and FIG. 5. A plurality of iron reinforcing rods or round rods 20 extend vertically from the upper surface of bottom plate 11 to which they are joined. A plurality of cross-arranged tightening holes 11A are provided in bottom plate 11 for securing the latter to a cross reinforced plate 12 by a plurality of bolts B or by welding the lower side of bottom plate 11 to the upper side of cross reinforced plate 12. Bolts B engage corresponding threaded holes 12A of cross reinforced plate 12. A plurality of reinforced blocks 12C with threaded holes 12B are welded to the four ends of cross reinforced plate 12 for receiving threaded bolts through holes 100B in the upper end of a steel pipe 100 for securing plate 12 to pipe pile 100.

A plurality of threaded holes 11B are spaced around the upper surface of bottom plate 11 for engagement by external threaded ends 21B of iron reinforcing rods or round rods 20 to secure rods 20 to plate 11. However, the diameters of threaded holes 11B and external threads 21B have to be greater than the diameters of iron reinforcing rods 20. Moreover, the upper surface of a bottom plate 11 and iron reinforcing rods or round rods 20 may be jointed by welding, as shown in FIG. 6.

Figure 7A:
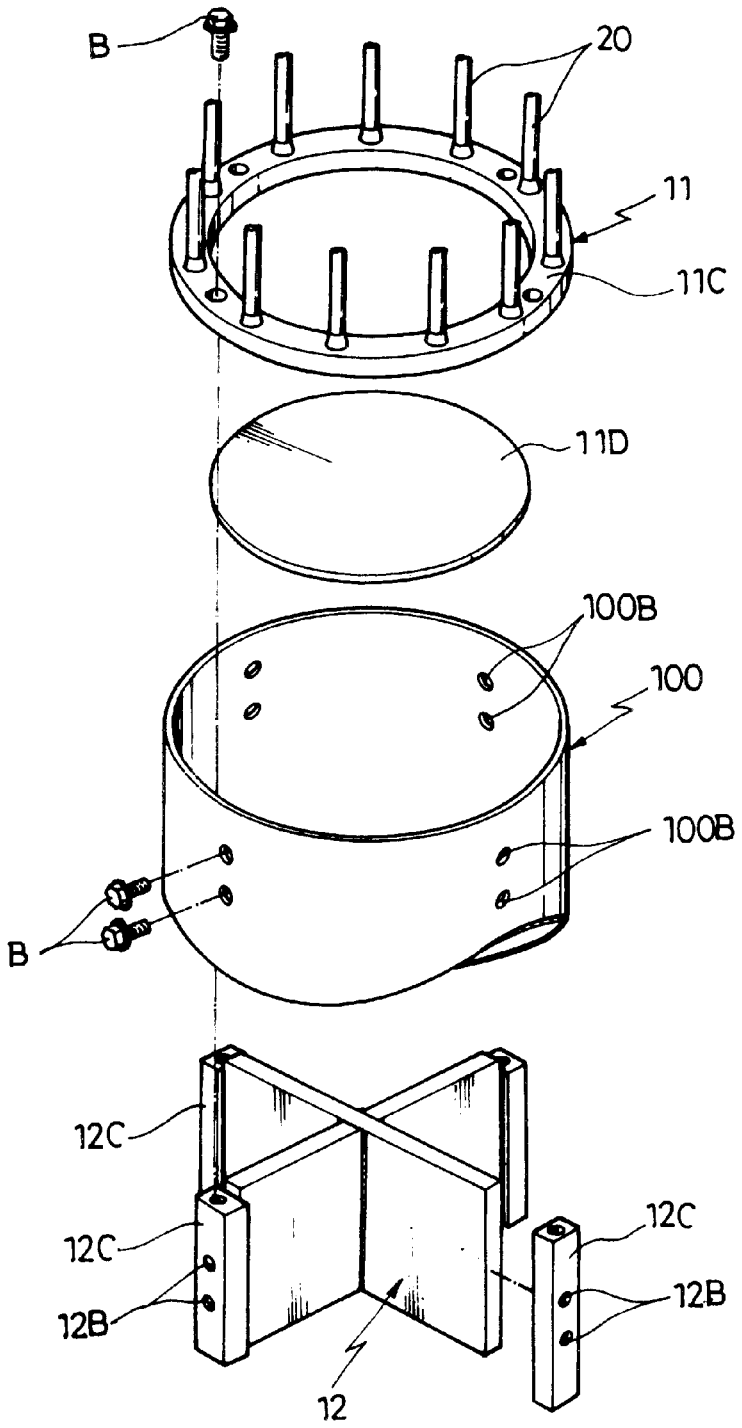
FIG. 7*a* and FIG. 7*b* comprise, respectively, an exploded perspective view and a sectional view of a fourth embodiment of the invention.
Figure 7B:
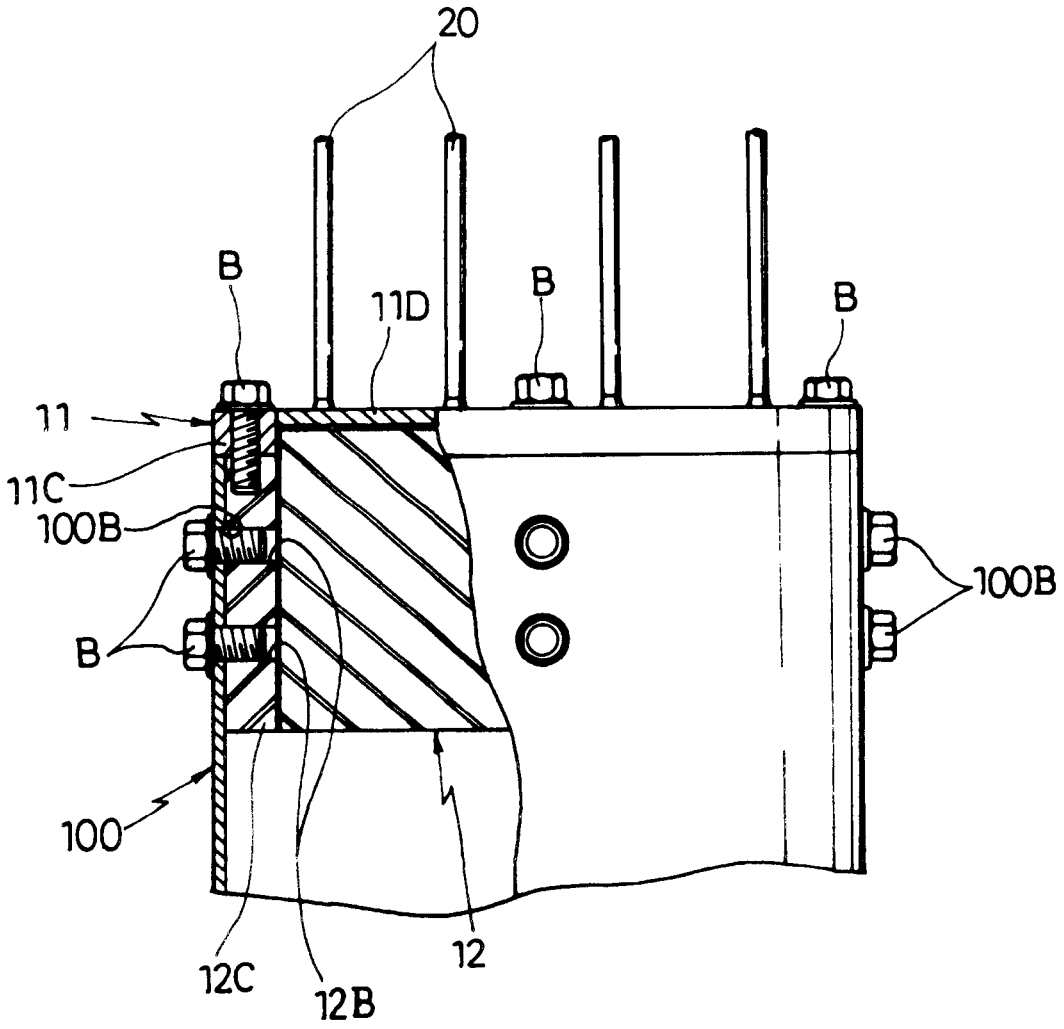

FIGS. 7*a* and 7*b* show another example of a covering plate assembly of this invention wherein bottom plate 11 includes a thin steel plate 11D that is inserted into a central opening of a ring-shaped member 11C which is secured to the upper side of reinforced blocks 12C of cross reinforced plate 12 by a plurality of bolts B. Steel plate 11D may be welded to the top of cross reinforced plate 12, as shown in FIG. 7B.

The properties and advantages of this invention as described above are as follows.

Figure 6A:
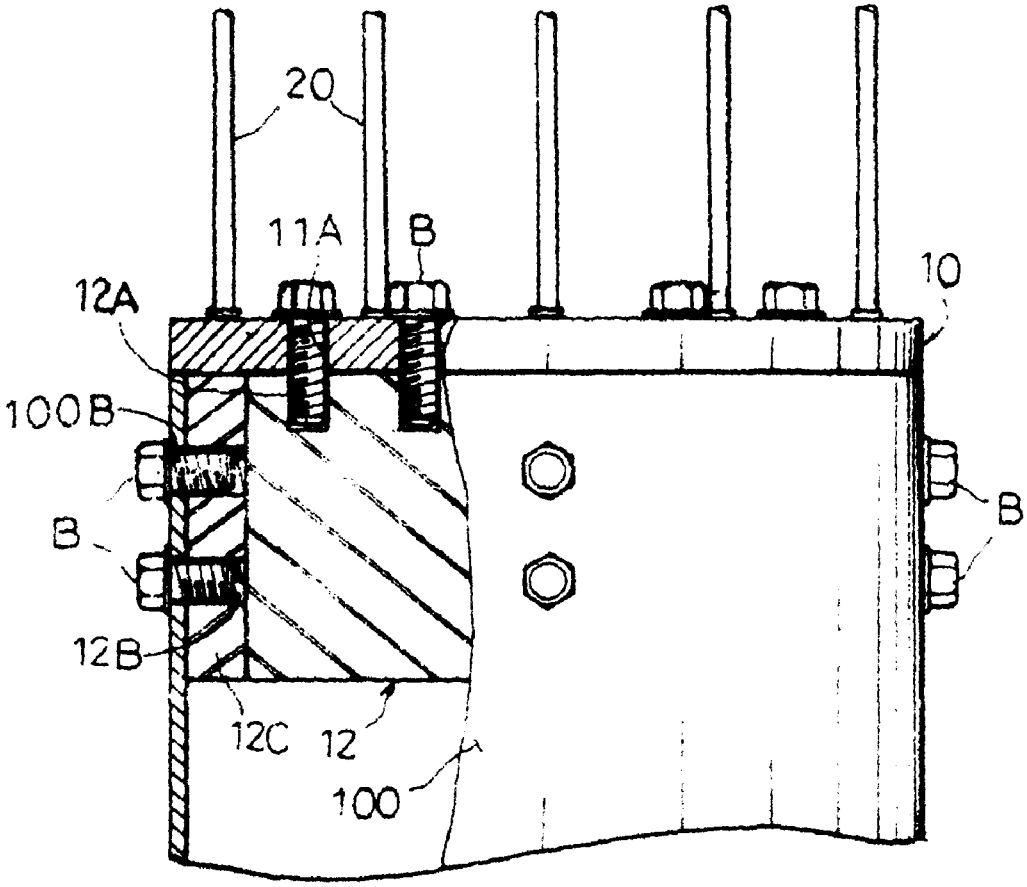
FIG. 6*a* and FIG. 6*b* show sectional drawings of a third embodiment wherein the iron reinforcing rods or round rods are welded to the bottom plate.
Figure 6B:
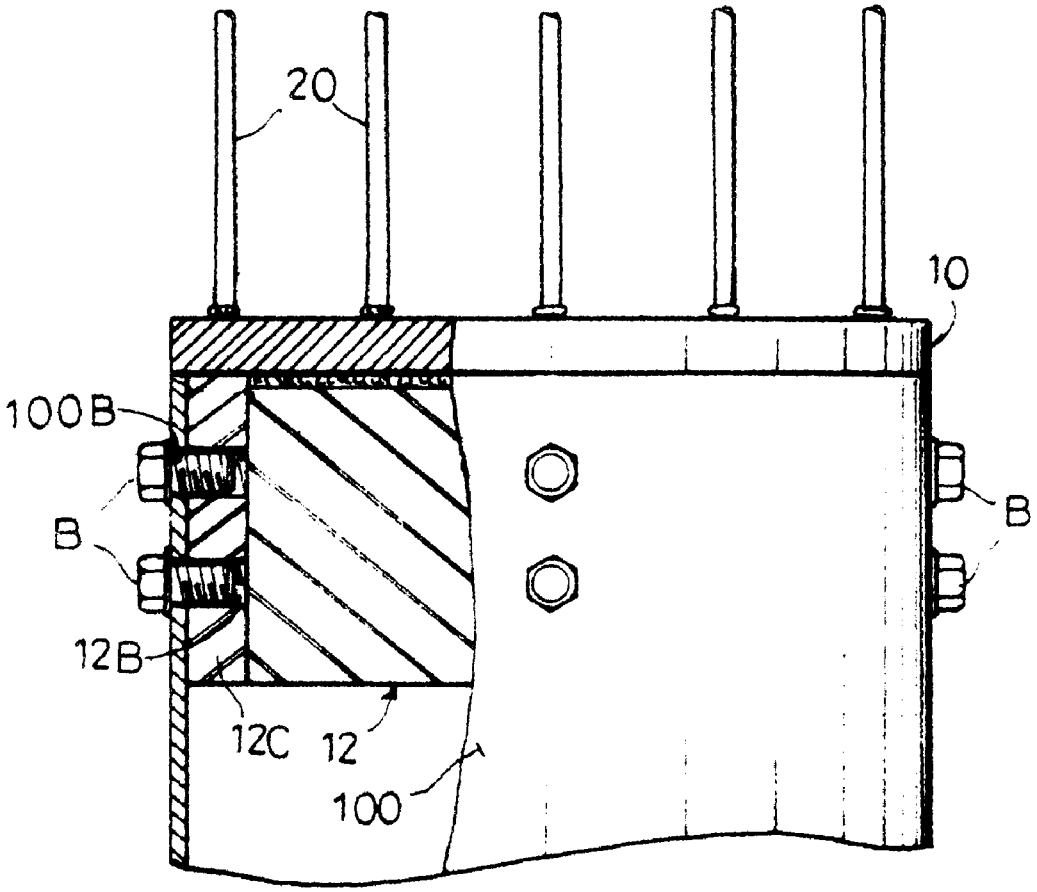

Initially, a bottom plate 11 of a covering plate assembly 10 is installed at the upper side of a cross reinforced plate 12 by engaging bolts B through holes 11A in plate 11 and threaded holes 12A of bottom plate 11. The cross reinforced plate 12 and bottom plate 11 may be inserted into the upper opening of the steel pipe pile 100. Plate 12 is then secured to pipe 100 by bolts B engaged through holes 100B of pipe 100 and into threaded holes 12B of plate 12. In addition, bottom plate 11 can also be joined to plate 12 by welding, as shown in FIG. 5 and FIG. 6*b*. This is preferred when the diameter of steel pipes 100 to be used is small.

A plurality of iron reinforcing rods 20 are secured to bottom plate 11 prior to receiving concrete of the foundation base.

Therefore, this invention has the advantage that a total load of the foundation base may be equally distributed on the steel pipe pile 100 by permitting the load of the foundation base to be equally transferred on the bottom plate 11.

This invention saves time and labor by providing a bottom plate 11 of a covering plate assembly 10 with iron reinforcing rods 20 secured by threaded engagement whereby the diameters of the threaded engagement are larger than the diameters of the iron reinforcing rods 20. Besides, the iron reinforcing rods 20 and bottom plate 11 may also be joined by welding, as shown in FIG. 6*a* and FIG. 6*b*.

The difficulty of providing tightening holes 12B in cross reinforced plate 12 is eliminated by fixing separate reinforced blocks 12C to the end faces of plate 12 and the joint areas of each reinforced block 12C is larger than each end area of plate 12 to enhance binding strength between plate 12 and pipe 100. This invention solves the difficult problem of machining threaded holes 12B on a cross reinforced plate 12 without changing its strength. Tests of practical examples of the invention showed a load of tension arrived at 16.103 kgf and the tensile strength arrived at 42 kgf/mm$^2$ when the area of iron reinforcing rods 20 was 384.4 mm$^2$, a 6–8 times increase over known assemblies of this type.

In addition, the bottom plate 11 is relatively thick, as seen in FIG. 7*a* and FIG. 7*b* and is expensive to produce. The unit production price may be lowered by using a ring-shaped member 11C and a thin steel plate 11D welded or joined to cross reinforced plate 12. This arrangement does not result in a change of strength.

Therefore, this invention permits the easy assembly and construction on the construction site of a covering plate assembly by directly attaching iron reinforcing rods on the upper side of a bottom plate to be covered on the upper side of a steel pipe pile.

What is claimed is:

1. A covering plate assembly for a steel pipe pile, the assembly comprising:

(a) a bottom plate having an upper side and a lower side;

(b) a cross reinforced plate having a top side and a plurality of end faces, the lower side of the bottom plate being secured to the top side of the cross reinforced plate;

(c) a reinforced block secured to each end face of the cross reinforced plate, each reinforced block including at least one threaded hole for engagement by a threaded bolt extending through a tightening hole formed in a wall of the pipe pile to secure the cross reinforced plate to the pipe pile; and (d) a plurality of reinforcing rods secured to and spaced around the upper side of the bottom plate and extending vertically therefrom.

2. The covering plate assembly of claim 1 wherein the bottom plate further includes a plurality of holes formed therethrough, the top side of the cross reinforced plate having a plurality of threaded holes formed therein, and a plurality of bolts extending through the holes of the bottom plate and in threaded engagement with the threaded holes of the cross reinforced plate.

3. The covering plate assembly of claim 1 wherein the lower side of the bottom plate is welded to the top side of the cross reinforced plate.

4. The covering plate assembly of claim 1 wherein the top side of the bottom plate includes a plurality of circumferentially spaced threaded holes and the reinforcing rods include threaded ends engaged within the threaded holes.

5. The covering plate assembly of claim 1 wherein each reinforcing rod includes an end welded to the top side of the bottom plate.

6. The covering plate assembly of claim 1 wherein the bottom plate comprises a ring-shaped member and a central plate member disposed within the ring-shaped member.

7. The covering plate assembly of claim 6 wherein the central plate member is welded to the top side of the cross reinforced plate and the ring-shaped member is bolted to each reinforced block.

* * * * *